United States Patent [19]

Grothoff

[11] Patent Number: 4,750,532

[45] Date of Patent: Jun. 14, 1988

[54] DEVICE FOR EXTRACTING LIQUIDS CONTAINED THEREIN AND ARRANGEMENT FOR FILLING THE DEVICE

[76] Inventor: Gisela Grothoff, Pulverstr. 35,, D 4600 Dortmund 50, Fed. Rep. of Germany

[21] Appl. No.: 942,088

[22] Filed: Dec. 11, 1986

[51] Int. Cl.[4] ..... B65B 3/12

[52] U.S. Cl. ..... 141/27; 141/113; 141/258

[58] Field of Search ..... 141/1–12, 141/18–27, 250–284, 113

[56] References Cited

U.S. PATENT DOCUMENTS 4,077,544 3/1979 Malacheski et al. ..... 141/27

FOREIGN PATENT DOCUMENTS 206892 8/1984 Fed. Rep. of Germany ..... 141/27

*Primary Examiner*—Houston S. Bell, Jr.

*Attorney, Agent, or Firm*—Michael J. Striker

[57] ABSTRACT

A device to be filled with viscous liquid and provided with a distributor for extracting the liquid contained in a cylindrical container of the device further includes a piston movable in the container. A filling opening is provided in the piston. A filling tube is tight-sealed attachable to the filling opening.

17 Claims, 7 Drawing Sheets

DEVICE FOR EXTRACTING LIQUIDS CONTAINED THEREIN AND ARRANGEMENT FOR FILLING THE DEVICE

BACKGROUND OF THE INVENTION

The present invention relates to a device for extracting liquids contained therein and to an arrangement for filling that device with the liquids.

The device for extracting liquids of low to high viscosity, of the foregoing type is comprised of a cylindrical or tubular container having a head connected to a distributor for discharging liquid in form of drops, cord or spray, contained in the container from the same, and a non-mechanically movable piston inserted in the container and tight-sealed placed in the inner wall of the container and connected to the discharge device.

Devices of the foregoing type have been known and have been employed for packing tooth pastes and hair cremes in many structural forms. Filling of such containers with viscous liquids has been however problematic. It has been suggested to mount an output device and eventually a protective hood directly from the packing means manufacturer to the container whereas the piston and the base of the container must be loosely supplied thereafter because these structural components can be assembled on the container after the latter has been filled, and a multiple filling process with high expense as well as additional organization and stockage costs have resulted therefrom. Air must have been removed from the device for the proper function thereof. For this purpose, the container wall in the region of the initial position of the piston should be formed either lozenge-shaped or provided with grooves or webs for guiding air from the container. Thereby the sealing between the piston and the container wall must be effective, and the product discharge should be provided, upon the insertion of the piston, without permitting the products to be dried up and the piston to be blocked. The initial sealing of the piston in the insertion region in the conventional devices for high-viscous fluidic preparations is, however limited. With low-viscous liquids, high losses of the products contained in such devices occur, and the devices can malfunction due to suction of air into the container.

A further disadvantage of conventional devices resides in packing expenses, particularly with products for every day use. The discharge devices operated on the pressure/suction principle are also rather expensive. Also, specifically with pharmaceutical preparations, requirements to sterilization are not met in the known devices because during the insertion of the piston the sealing is not warranted. Finally it should be noted that it is impossible with conventional devices that the liquid can be removed automatically from the device as required with pharmaceutical products.

SUMMARY OF THE INVENTION

It is an object of the present invention to provide an improved liquid containing device capable of extracting that liquid therefrom.

It is a further object of this invention to provide a pre-assembled unit filled with liquid, which can be vented before being filled and which is sealed at the beginning and is sterilizable as a unit.

It is another object of the invention to provide a device for extracting low-viscous liquids contained therein.

Yet another object of the invention is to provide a device which can be refilled and can ensure a self-driving extraction of the liquid.

Still a further object of the invention is to provide an improved arrangement for a complete filling and sealing of the device from which liquid is to be extracted.

These and other objects of the invention are attained by a device filled with low-viscous up to high-viscous liquid and capable of extracting the liquid therefrom, comprising a cylindrical tubular container having a head side provided with a liquid-discharging means, said liquid-discharging means including a distributor for extracting liquid in form of drops, cord, stream or spray, said container having an inner wall; a piston inserted in said inner wall and tight-sealed movable therein, said piston being non-mechanically connected to said liquid discharging means, said container including a liquid storage chamber; means defining a filling bore for filling said container, said filling bore opening into said liquid storage chamber; and means for tight-sealed closing said filling bore after said container has been filled with liquid.

The filling bore may be formed centrally in said piston.

The container has a wall positioned opposite to said liquid-discharging means, the filling bore may be formed in said wall. This embodiment is suitable when the liquid storage chamber faces away from the liquid discharging means.

The liquid-discharging means may be formed by a finger-actuated pressure/suction pump automatically returnable to an initial position so that dosing of the liquid can be obtained with high precision. The pump may be formed directly in the container.

The device may further include a pretressed compression spring which loads said piston at a side thereof facing away from said liquid storage chamber. The internal pressure in the container is therefore adjustable by said spring. For example, the internal pressure with the device having the inner diameter 25 mm and feeding volume 20 ml is 1.5 bar and is reduced, upon emptying of the container, to 0.7 bar.

The liquid-discharging means may be provided for a single non-reclosable opening. The container may be formed of glass with a drawn tip which can be breakable. Also possible is the container made of synthetic plastic material by injection-molding. Such a container may have a liquid-removing tube separable from the container.

The liquid-discharging means may include a one-way valve which opens, upon actuation and automatically closes again after unloading. This valve is easy and inexpensive to manufacture. Such a structure is advantageous when individual amounts of liquid must be removed from the container.

The device may further include a displaceable spring support having a central opening and provided at an underside with a back pressure safety portion engaged on a container wall, said compression spring, upon the displacement of said spring support, being retightened in the direction towards said piston. This self-driving structure permits the removal of the liquid from the container per time unit within acceptable limits.

The closing means may be of a diameter greater than that of said filling bore and is secured in said filling bore under prestressing. This ensures reliable sealing of the filling bore. By the provision of circular grooves or rings in the filling bore, holding and sealing of the closing means may be further improved.

The closing means may include a valve which opens upon pressure loading in the direction towards said liquid-storage chamber and automatically closes upon unloading. Thereby refilling of the device after the latter has been emptied is possible. The self-closing valve must operate with a sufficiently high sealing so that the self-opening due to underpressure in the piston chamber, caused by emptying of the device would be prevented.

The closing means may be formed by a ball. This particularly facilitates mounting of the closing means in the liquid-extracting device. A ball can be formed with high precision and sterilized in a simple fashion.

The objects of this invention are further attained by a combination of the filling device with the liquid extracting device whereby a rational and clean manufacture of the liquid-extracting device is possible.

The filling device may include a filling tube tight-sealed attachable to said filling bore so that specific sealing elements can be avoided. The contour of the filling bore may be adjusted to that of the filling tube.

The piston of the liquid-extracting device may have a back pressure safety means which is mechanically released by said filling tube during a filling process. Thereby a reliable function of the device can be ensured even upon the first actuation.

The liquid-filling device may further include means for venting said liquid storage chamber via said filling tube before the filling process. The device as well as the closing means may be subjected to gas or radiation sterilization.

The liquid-filling device may further include means for inserting said closing means into said filling bore after the completion of the filling process under maintenance of a sealed connection between said filling tube and said filling bore and under displacement of the liquid contained in said container.

The inner diameter of said filling tube may be smaller than an outer diameter of said closing means, at least said filling tube and said closing means being formed of elastic material with spring-restoring properties. As a rule the closing means, e.g. a closing ball is formed of elastic material. It is also possible that the filling tube itself be made of viscous elastic material, for example polyurethane while the closing element may be made of hard material, for example metal.

The device according to this invention can be employed in many industries and is specifically advantageous in the pharmaceutical field.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENT

Figure 1:
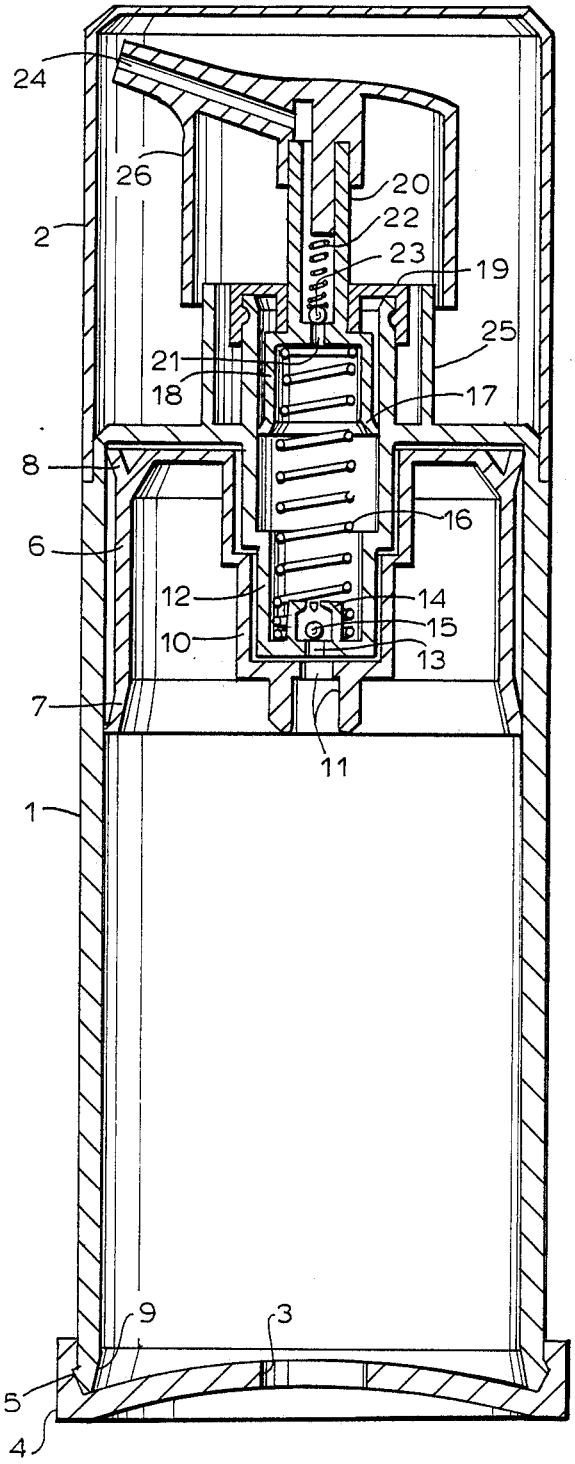
FIG. 1 is an axial sectional view of a yet non-filled device for a liquid removal with a pressure/suction pump.

Referring now to the drawings in detail and first to FIGS. 1 to 4 thereof, it will be seen that the device for a liquid removal is comprised of a cylindrical container 1 which is superimposed at the upper side thereof with a protective cap or hood 2 and is covered at the underside thereof with a base 4 which forms a pedestal of the container and is provided with a bore 3. The underside of the container is connected to the base 4 by means of a snap connection 5. A piston 6 positioned within the container includes elastic sealing lips 7, 8 at two opposing ends of the piston, which lips form an oversized portions of the piston relative to its diameter, and, for facilitating of the assembly of the container, an insertion cone 9 is provided at the lower end of the container. Piston 6 has in the central region thereof a tubular portion 10 which corresponds to the contour of a respective tubular central portion or extension 12 of the container which is inserted into portion 10. The latter is provided with a filling opening 11. A through opening 13 formed in the tubular extension 12 of container 1 is covered with a ball 15 loosely positioned in a cage 14. A prestressed spring 16 acts on a flange 18 formed with a sealing lip 17. Flange 18 is supported and guided by means of a disc 19 at which flange 18 is snapped. A bore 21 provided in a shaft 20 formed on the flange 18 is closed via a pretressed spring 22 with a ball 23. A distributer 26 which is set on a tubular upper extension 25 of container 1 is mounted on the shaft 20 of the flange 18. The distributor 26 is formed with a through bore 24.

Figure 2:
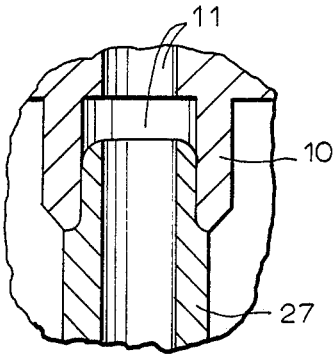
FIG. 2 is a region II of the filling bore with an inserted filling tube of FIG. 1, on enlarged scale.

FIG. 1 illustrates the position of the device before filling with liquid. For filling of the container, as shown in FIG. 2, a filling tube 27 connected to the non-shown filling device is sucked via bore 3 onto the piston 6 and is sealingly inserted into the filling bore 11. If necessary the piston 6 travels to an emptying position over the filling tube 27 for the removal of air contained in the piston chamber; however in the normal case the device has been moved in this position to the filling operation. By the movement of the piston in the backward direction during the filling process relative to the container it must be detected under the maintenance of the filling tube sealing in the filling bore as to whether the forcible backward movement of the filling tube or the container synchronously with the filling amount is obtained or this movement is automatically regulated by springs, pneumatic or hydraulic cylinders.

Figure 3:
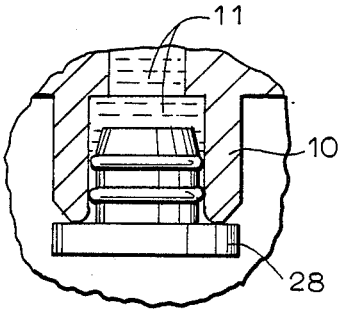
FIG. 3 is a partially sectional view corresponding to that of FIG. 2 but with the plug which closes the filling bore.

After the completion of the filling process, a closing plug 28 is pressed into the filling bore 11 in the following operation, as shown in FIG. 3.

Figure 4:
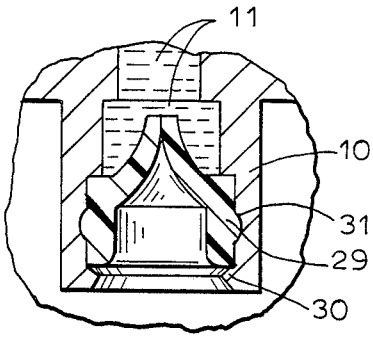
FIG. 4 is a view similar to that of FIG. 2, but with a self-locking one-way valve which closes the filling bore.

FIG. 4 shows a self-locking one-way valve 29 formed of elastic material which is secured by holding rings 30, 31 formed in the walls of the filling bore 11 of the piston portion 10. In the normal position lips 32, 32 which seal-tightly abut against each other open automatically upon the filling of the container due to pressure of the liquid and automatically close upon pressure fall, that is during the completion of the filling process. This arrangement makes possible refilling of the device by very simple means, for example with a snap bottle via the connection tube, whereby it is provided that lips 32, 33 are injection-molded through the tip of the connection tube and the passage is mechanically open.

The device is set into operation after lifting of the protective hood 2 by the actuation of the distributor 26. Air which is initially contained in the discharge device is compressed by offsetting the flange 18, the resulting overpressure lifts the ball 23 from the bore 21, and air is pushed through the bore 24 out. The overpressure resulting from the returning stroke of the flange 18 lifts the ball 15 from the bore 13 and permits the liquid to flow from the fluid storage chamber while piston 6 runs into the output device. After a few actuation strokes the air is completely removed from the device and the device performs dosing of the liquid whereby this process is repeated until piston 6 reaches its end position. The shape of the distributor with the bore 29 shown in FIG. 1 can be, depending upon viscosity of the liquid being treated and the diameter of bore 24, of a rope, a beam or a drop. In order to atomize the liquid it is necessary to provide bore 24 with a non-shown conventional vortex-type atomizing nozzle.

Figure 5:
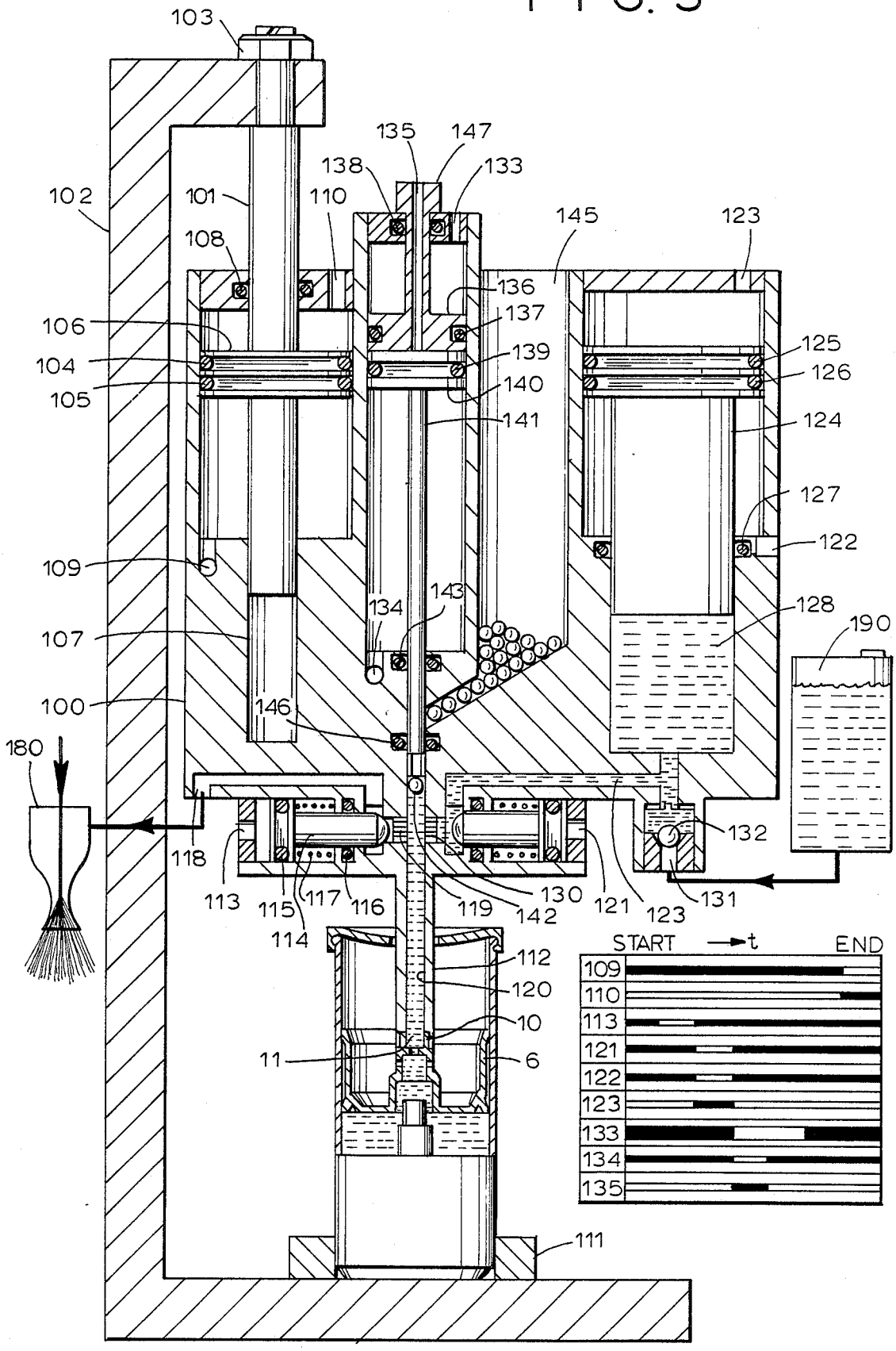
FIG. 5 is an axial sectional view of the device for filling and closing the device shown in FIG. 1.

With reference to FIG. 5 it is seen that a pneumatically operated device for filling and closing the device of FIG. 1 includes a specific aggregate 100 which is suspended on an upright column 102 by means of a piston rod 101 and is secured to that column by a nut 103. The piston rod 101 carries thereon a piston 106 provided with seal rings 104, 105. Piston rod 101 is axially guided through a bore 107 and is sealed from the atmosphere by a seal O-ring 108. Before initiating the filling process the aggregate 100 is in its upper position and a pressure air connection 109 has no pressure while a connection 110 is loaded with pressure air. The device corresponding to FIG. 1 is shown in FIG. 5 in a reversed position in which the device of FIG. 1 is inserted into a centering ring 111. After this insertion the filling process starts. The air connection 110 is vented for this purpose and the connection 109 is loaded with pressure air whereby the aggregate 100 is lowered onto the device of FIG. 1. A filling tube 112 extends through bore 3, overlaps the tubular portion of piston 6, seals the latter and pushes piston 6 until the stop in the device to be filled with liquid of FIG. 1. At the same time, a pressure air connected 113 is vented, a piston 114 with seal rings 115 and 116 thereon is pushed back by the force of a spring 117, and vacuum, that occurs at a connection 118 of aggregate 100, removes, via a sieve-type plate 119 and an inner bore 120, a remaining air contained in the piston chamber of the device to be filled with liquid. After a period of time sufficient for a further pressure release this connection is again loaded with pressure air. Simultaneously, connections 121 and 122 are vented and a connection 123, provided in the housing of aggregate 100, is loaded with pressure air, and a liquid-dosing piston 124 provided with seal O-rings 125, 126, 127 and movable in a chamber of aggregate 100 pushes an amount of liquid contained in a dosing chamber 128 through a feeding passage 129, a sieve plate 130 and bore 120 of the filling tube 112, and via the filling bore 11, into the liquid storage chamber of the device to be filled. The liquid displaces piston 6, with carrying along of the aggregate 100, upwardly whereby it is required to adjust air pressure at the connection 109 to avoid the pressure overload of the device being filled with liquid. Particularly when the weight of aggregate 100 is very high the aggregate itself is stationary, and the axial movement during the filling of the device of FIG. 1 is carried out by a pressure air cylinder positioned below the device being filled with liquid. After the completion of the filling process, connections 121 and 122 of aggregate 100 are again loaded with pressure air while the connection 123, upon the backward movement of piston 124, is vented whereby the dosing chamber 128 is refilled with liquid through a non-shown liquid-supply conduit connected to a passage 131 formed in the housing of aggregate 100, provided that a ball 132 of a check valve opens. At the same time, connections 133 and 134 are released from pressure, and pressure air is fed into a connection 135. In a central chamber formed in the housing of aggregate 100, a limiting piston 136 is positioned, which is provided with seal rings 137 and 138 and moves back from the illustrated position until it strikes against the stop whereas a piston 140 provided with a seal ring 139 moves in front of piston 136 and presses with a piston rod 141 a ball-shaped locking element 142 made of elastic material through the inner bore 120 into the filling bore 11 of piston 6 of the device being filled with liquid. Thereby the locking element which is greater in the diameter than the inner bore of the filling tube, is sealed in the latter and feeds the liquid into the liquid storage chamber of the device being filled. By the pressure feeding at the connection 134 and pressure release at the connection 135, piston 140 moves back until it strikes against the limiting piston 136 located in the upper position, under the sealing of the piston rod 141 by a seal ring 143. A magazine 145 for locking elements is provided in the aggregate 100. A feeding passage 144 of the magazine 145 is released when the piston rod 141 is moved upwardly, and the locking element rolls into the space above the seal ring 146 held in the inner bore 120 of the diameter greater than that of the locking element. Upon pressure feeding at the connection 133 so that an air pressure is adjusted to be higher than that at the connection 134 the piston 136, with carrying along of the piston 140, moves down until the abutment of a limiting head 147 strikes against the wall of the aggregate and transports the locking or closing element to the sealing position within the inner bore 120. The filling tube is pulled away from the filled and closed device by venting the connection 109 and applying pressure air to the connection 110 so that the aggregate is moved to its upward position and the device for filling the liquid is set onto the next device to be filled. A vacuum pump is designated by reference numeral 180 whereas a storage container connected to line 131 is denoted by reference numeral 190. In a pressure diagram for the different connections for one filling process, also shown in FIG. 5, the black parts of the line indicate "under pressure" conditions and the white parts identify the time without pressure.

The liquid-filling device illustrated in FIG. 5 can be utilized for filling and closing of the devices in which a filling bore is formed not in the piston but in the wall of the container. Thereby during the filling process with such devices, no height change occurs between the filling device and the device to be filled and the lowering of the aggregate can be carried out with a small stroke and no precise adjustment of the compressing pressure would be required as in the case of the filling bore in the piston. Generally other arrangements are possible. For example, the filling device itself can be stationary and the device to be filled with liquid could be movable by the lifting device positioned below the device being filled. For weight reduction of the filling device in some instances the dosing piston could be mounted separately from the filling device and connected to the same by a hose.

Figure 6:
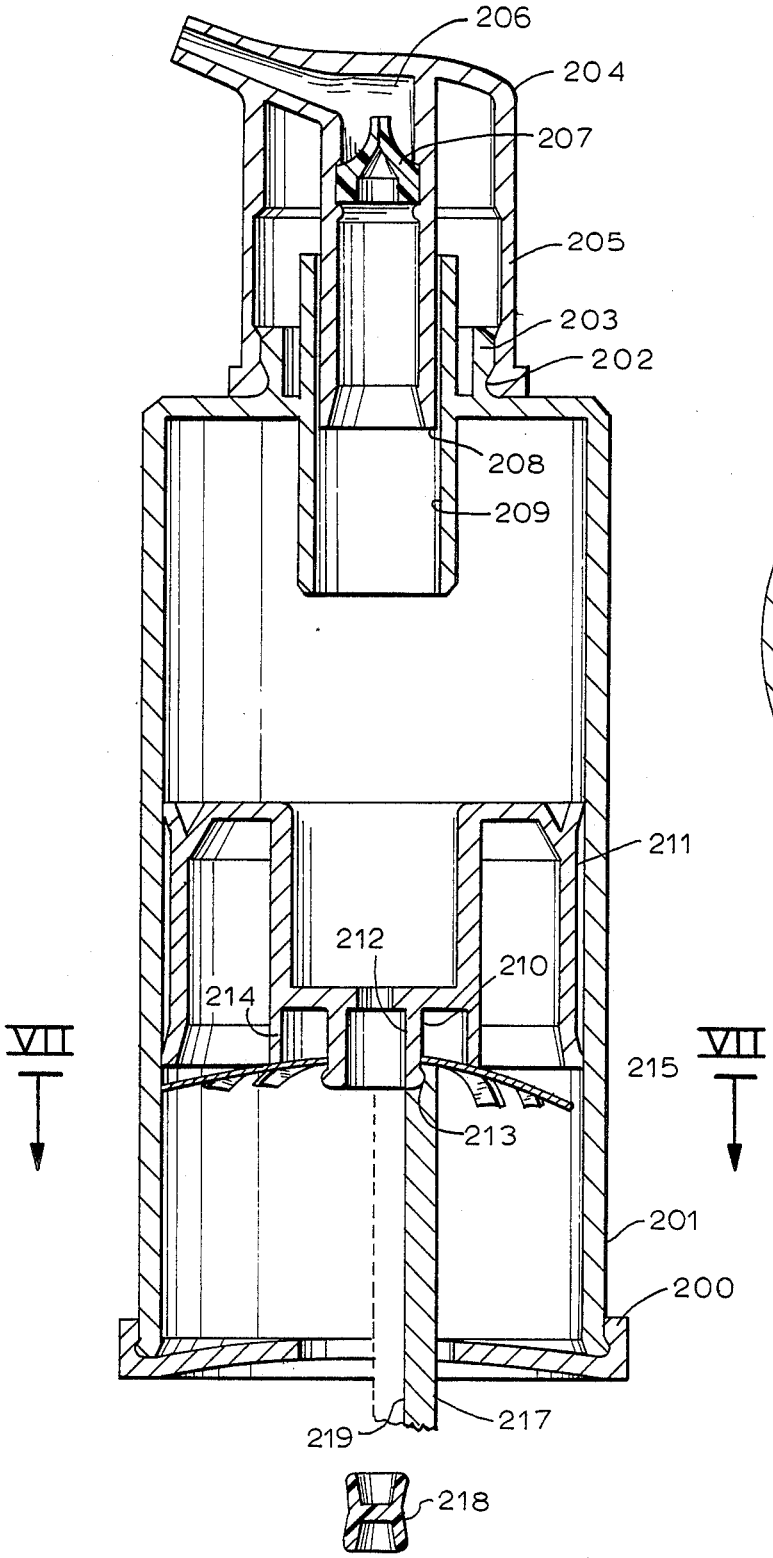
FIG. 6 is an axial sectional view of the device for a liquid removal with a piston-back pressure-safety arrangement.
Figure 7:
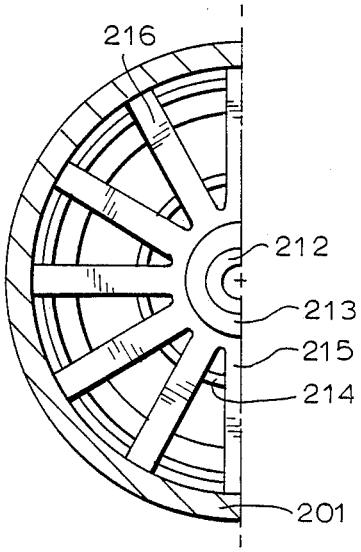
FIG. 7 is a broken sectional view along line VII—VII of FIG. 6.

A device to be filled with liquid illustrated in FIGS. 6 and 7 is comprised of a cylindrical container 201 closed with a holed base 200 and a distributor 204 connected to the container via snap projections. Distributor 204 is made of elastic material with good reset properties and at the same time, has the function of the discharge device. The portion 205 with a reduced wall thickness functions as a spring element which curves or cambers during the actuation and pushes the distributor back to the initial position during the unloading. The distributor 204 has a one way check valve 207 positioned in a bore 206 and is provided with a flange lip 208 which seals the interior of a cylindrical bore 209 of the container. An extension 210 of a piston 211 formed with a filling bore 212 serves to fill the device and has a circular collar 213. Extension 210 of the piston is formed by a ring 214. As can be seen from FIG. 7, a back pressure safety element 215 made of elastic material, preferably sheet material, is secured on the ring 214 behind the collar 213, whereby radially extending elastic tongues 216 lie on the inner wall of container 201 under prestressing. These tongues prevent the backward movement of piston 211 in the direction towards the base 200 and permit only its movement in the direction towards the distributor 204 whereby, upon the actuation of the distributor, the liquid displaced by the forward stroke of the flange lip will be forced via the one-way valve 207 towards the outlet through the distributor. Vacuum that is generated during the resetting of the distributor 204 draws piston 211 by the amount of the liquid being removed. For filling the device of FIG. 6 it is necessary to enable the backward movement in the direction of base 200 of the piston displaced up to the limiting surface of the container, whereby it is obtained that the filling tube 217 sealed at the collar 213 of the extension 210 pushes back the back pressure safety washer 215 at the inner diameter thereof so that by the support on the ring 214, the resilient tongues 216 are supported by the container wall. After the completion of the filling process a locking element 218 is inserted through the inner bore 219 of the filling tube into the filling bore 212 as described above, and the filling tube finally travels back.

Figure 8:
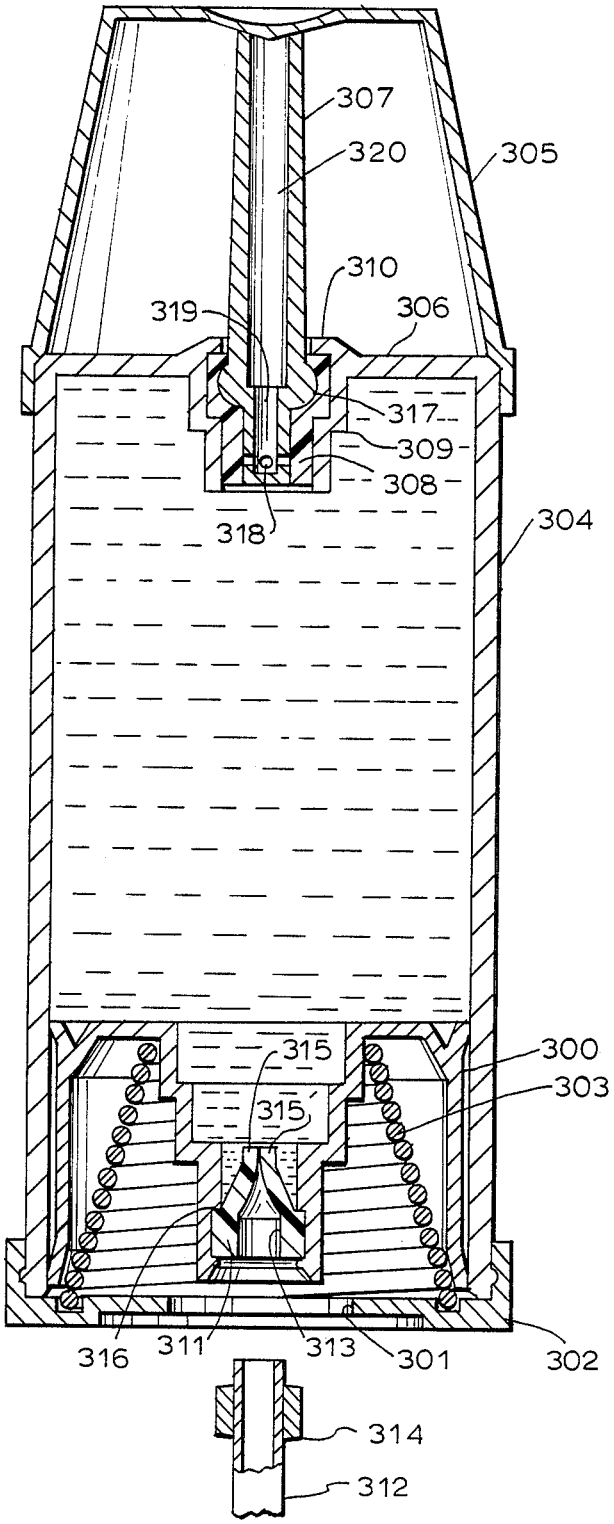
FIG. 8 is an axial sectional view of a self-driving structure with a prestressed compression spring of the device for a liquid removal.

FIG. 8 depicts a further embodiment of the device to be filled with liquid. This device has a base 302 having a bore 301, a container 304 and a piston 300. A prestressed spring 303 is provided between the base 302 and the transverse wall of the piston 300. The cylindrical container 304 is overlapped with a protective hood 305 and includes inside a head plate 306 an output or discharge device which is comprised of a distributor tube 307 and a sealing element 308 which are secured in a container extension 309, for example so that, after the insertion of the distributor tube 307 pre-assembled with the sealing element, a circular extension 310 of the container head plate which originally extends in the axial direction would tilt inwardly in the radial direction. The filling and closing of the device of FIG. 8 is similar to that of the device shown in FIG. 5. In the embodiment of FIG. 8, a one-way check valve 311 inserted in a filling bore 316 of the piston acts as a locking element, particularly for refilling, whereby the filling tube 312 connected to a non-shown dosing device is inserted into a centrol bore 313 of the self-locking valve so that according to the insertion depth adjusted on the filling tube by a stop or abutment 314, the sealing lips 315, 315' either mechanically open by the filling tube or open firstly automatically by the filling pressure of the liquid to be filled and then close. For the discharge of the liquid, the distributor tube 307 is laterally actuated whereby the portion of the distributor tube located below a holding ring 317 at one side is pressed into the elastic material of the sealing element 308 and thereby lifts a seal connection at the opposite side. The liquid then flows through at least one of transverse holes 318 into the axial bore 319 of the distributor tube and through the central opening 320 under the piston forward stroke as long as the actuation is lasting.

Figure 9:
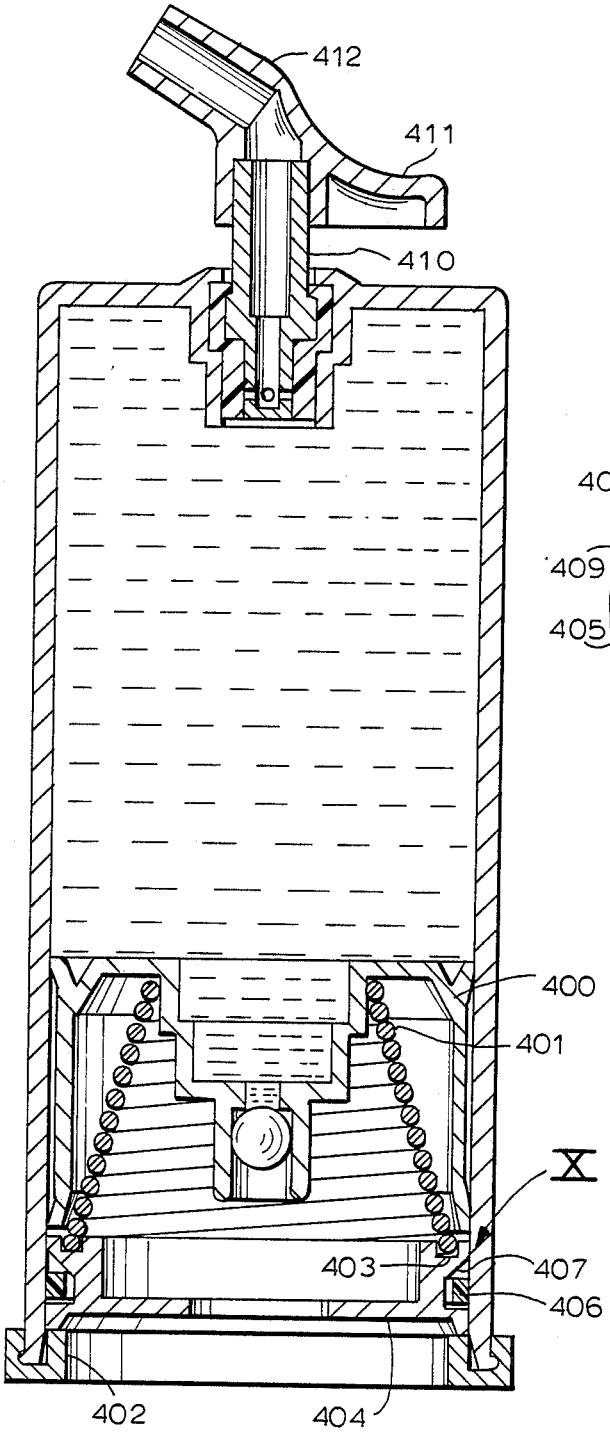
FIG. 9 is an axial sectional view of the self-driving structure with a retightenable prestressed compression spring, of the device for a liquid removal.
Figure 10:
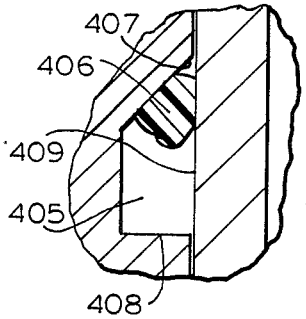
FIG. 10 is a region X of FIG. 9 on enlarged scale.

In order to avoid strong pressure reduction while the container is emptied, an embodiment shown in FIGS. 9 and 10 is proposed. In this embodiment, a displaceable spring support 404 is provided between a spring 401, lying against the wall of piston 400 and also supported in a groove 403 formed in support 404, and a base 402. A ring 406 inserted in a recess 405 of the spring support 404 cooperates with a sloped wall 407 of the back pressure safety portion of the spring support. A flat surface 408 serves to take along the ring abutting against the container wall during the displacement of the spring support. When the spring support tends move back the ring, due to the spring force exerted thereon, wedges in the region of the sloped wall 407 and therefore prevents the backward movement of the spring support 404 as shown in FIG. 10. To ensure this function the ring is made, for example of rubber coated with a light abrasive material having high friction properties. The spring support 404 pre-assembled with the ring 406 is pressed into the container via the base 402 so that the back pressure safety is automatically obtained in the lowermost position, and the filling with liquid as described in connection with FIG. 5 can be normally performed. The liquid removal device in FIG. 9 is similar to that of FIG. 8. The distributor tube 10 is shorter and has a finger application surface 411 so that, upon actuation, a tilting movement is forcibly applied to the distributor 412.

Figure 11:
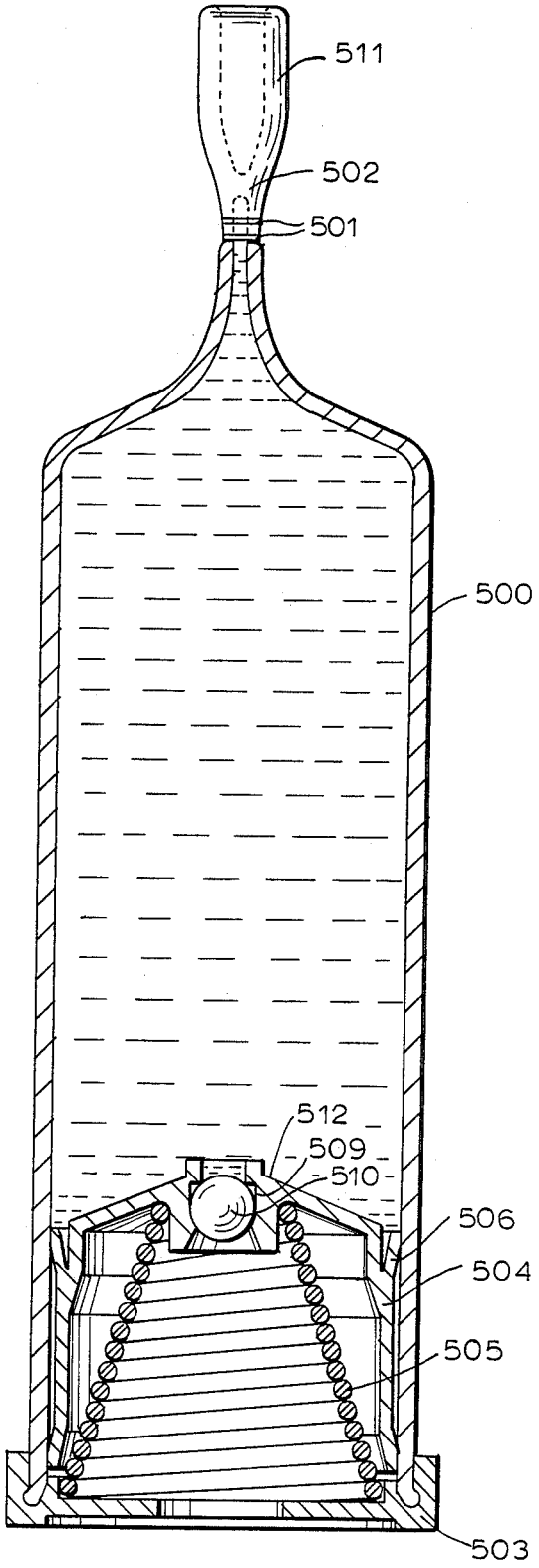
FIG. 11 is an axial sectional view of the self-driving structure of the device for a liquid removal with a prestressed compression spring and a breakable removal tube for removing the entire liquid, in a stressed position.

In the embodiment shown in FIG. 11, container 500 has at the upper end thereof a tip drawn from the body of the container. A marked breakable location 501 with a locking part 502 are made, for example by melting. A base 503 is provided at the underside of the container. Base 503 supports in a snap seat thereof one end of a prestressed spring 505 which acts on a piston 504. The piston lips 506, 507 lie sealed against the inner wall of the container under prestressing. The wall of the container under prestressing. The piston has a filling bore 509 which has a portion of a reduced diameter towards the interior of the container. The filling of the container with liquid is carried out in the same fashion as that described for FIG. 5, whereby the filling bore is closed with a ball 510 after the completion of the filling process. For the removal of the liquid from the container, an extension 511 of the container is removed, for example by breaking. The energy stored in the spring pushes the liquid through the released opening out of the container until the latter is emptied that is until the end face 512 of the piston strikes against the inner upper wall of the container, whereby the contours of the piston and the inner upper wall of the container should be advantageously adjusted to each other so that only a small residual amount of liquid would remain in the container.

Figure 12:
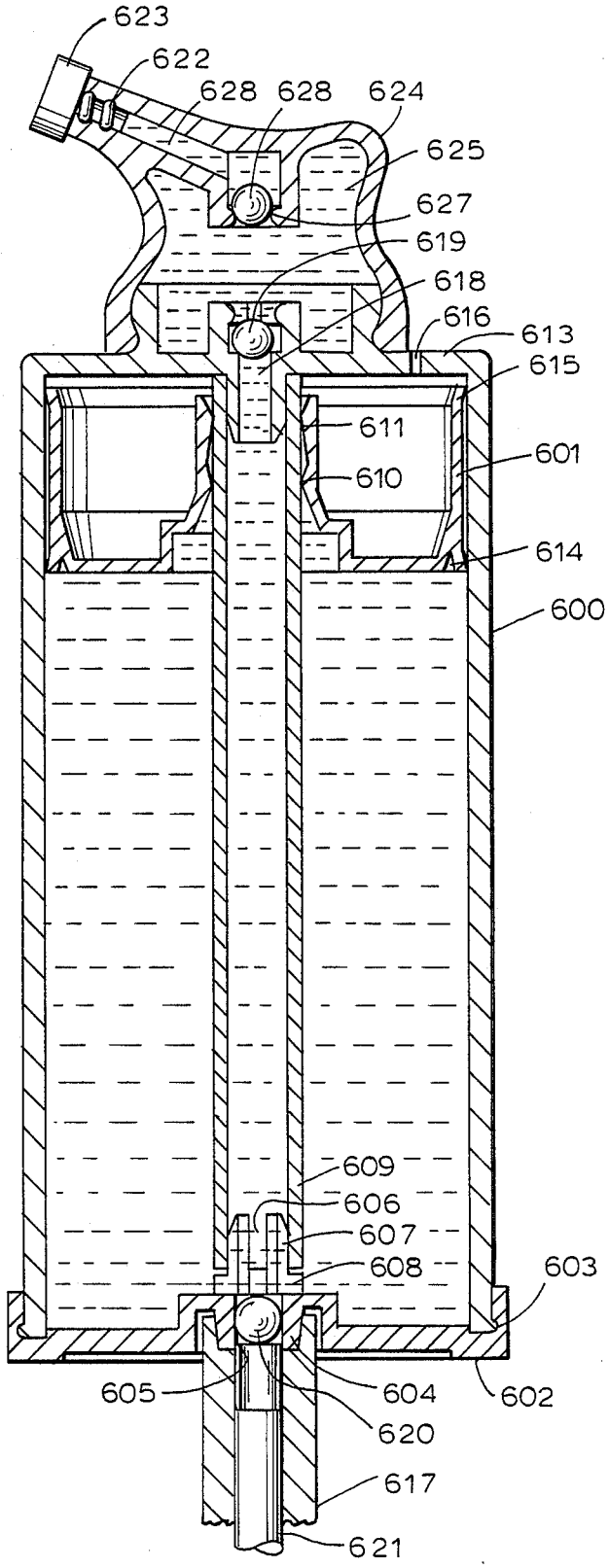
FIG. 12 is an axial sectional view of the device for a liquid removal with the arrangement of the filling bore in the container wall after filling and closing the filling bore.

The embodiment shown in FIG. 12 functionally is somewhat different from those described above. The liquid in a container 600 of this device is contained not above but below a piston 601 accommodated in the cylindrical container. The piston 601, during the liquid removal from the container, is moved in the direction towards a base 602 whereby the center of gravity of the container upon continual emptying thereof, is displaced downwardly which positively affects the rigidity of the device. The base 602 is tight-sealed connected with the container body by a snap connection 603 and has a circular projection 604 provided with a filling bore 605. A further projection 607 provided with a slot 606 and extending upwardly is connected to the upper surface of projection 604. Projection 607 has a flange 608 which supports an ascending tube 609. This tube extends centrally through the piston 601 the contour of the lower end face of which corresponds to that of the upper end face of the base 602 whereby by means of sealing zones 610, 611, the sealing of the chambers above and below of the piston is warranted. Tube 609 at its upper end abuts against an extension 612 of the head plate 613 of the container. The sealing of the piston relative to the container body is obtained by lips 614, 615. For venting the space above the piston, a bore 616 is provided. The filling of the device with liquid is carried out in the manner disclosed in connection with FIG. 5. The filling tube 617 is tight-sealed set on the projection 604, and the piston automatically moves, upon the application of vacuum, to its lower position. The dosed liquid flows through the filling bore 605 and through the released slot 606 in the region of projection 608 into the space below the piston under dislocation. At the same time, the inner space of the ascending tube 609 is filled with liquid up to a ball 619 which seals a bore 618. After the completion of the filling process a ball-shaped locking element 620 is tight-sealed pressed by means of the piston rod 621 into the filling bore 605 of the base 602, and the filling tube is removed from the device. For discharging of the liquid from the container, a closing plug 623 provided with a thread 622 and serving as a transport protective element is removed, and a distributor 624 formed of elastic material with spring-restoring properties and connected by means of a bead 629 to a respective counter bead of the container, is actuated by finger pressure. The overpessure generated thereby in an inner chamber 625 of the distributor lifts a ball 626, which serves as an output valve, from a sealing head 627, and air initially contained in that chamber escapes via a discharge bore 628 under the deformation of the distributor. The pressure release at the distributor 624 forms due to the restoring of the distributor to its initial shape, a vacuum whereby the ball 626 closes the discharge bore whereas ball 619 releases the through opening 618, and the liquid is sucked from the container into the inner space 625 of the distributor and is then discharged through the opening 628. The reduction of the liquid amount in the container is balanced out by the stroke of the piston whereby the liquid-discharging process is repeated until the piston 601 reaches the lowermost position at the wall of the base 602.

It is, of course, understandable that other embodiments of the invention are possible. For example, some features of the above described embodiments could be combined. For example, in the embodiment of FIG. 12 the container itself can be provided with the filling opening and the snap connection can be made in the region of the cover. Also, by employing a spring and a through valve the embodiment of FIG. 12 may be modified into yet another self-driving construction.

It will be understood that each of the elements described above, or two or more together, may also find a useful application in other types of devices for discharging fluids from containers differing from the types described above.

While the invention has been illustrated and described as embodied in a device for the removal of liquid from the container, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device to be filled with low-viscous up to high-viscous liquid and capable of extracting the liquid therefrom, comprising a cylindrical tubular container having a head portion; a liquid-discharging means inserted in said head portion, said liquid-discharging means including a distributor for extracting liquid in form of drops, cord, stream or spray, said container having an inner wall and being formed with a liquid storage chamber; a piston inserted in said inner wall and tight-sealed movable therein, said piston being non-mechanically connected to said liquid-discharging means; means defining a filling bore for filling said container, said filling bore being formed in said piston at a side thereof facing away from said liquid-discharging means and opening into said liquid storage chamber; and means for tight-sealed closing said filling bore after said container has been filled with liquid.

2. The device as defined in claim 1, wherein said filling bore is formed centrally in said piston.

3. The device as defined in claim 1, wherein said container has a wall positioned at said opposite end, said wall having an opening for receiving a filling tube which is connected to said filling opening in said piston.

4. The device as defined in claim 1, wherein said liquid-discharging means is formed by a finger-actuated pressure/suction pump automatically returnable to an initial position.

5. The device as defined in claim 1, further including a pretressed compression spring which loads said piston at a side thereof facing away from said liquid storage chamber.

6. The device as defined in claim 5, wherein said liquid-discharging means is provided for a single non-reclosable opening.

7. The device as defined in claim 5, wherein said liquid-discharging means includes a one-way valve which opens upon actuation and automatically closes again after unloading.

8. The device as defined in claim 7, further including a displaceable spring support having a central opening and provided at an underside with a back pressure safety portion engaged on a container wall, said compression spring, upon the displacement of said spring support, being retightened in the direction towards said piston.

9. The device as defined in claim 7, wherein said closing means is of a diameter greater than that of said filling bore and is secured in said filling bore under prestressing.

10. The device as defined in claim 9, wherein said closing means includes a valve which opens upon pressure loading in the direction towards said liquid-storage chamber and automatically closes upon unloading.

11. The device as defined in claim 9, wherein said closing means includes a ball.

12. A filling device in combination with a device capable of extracting said liquid therefrom and including a cylindrical tubular container having a liquid storage chamber, liquid-discharging means with a distributor for extracting liquid, a piston tight-sealed movable in said container, said piston being formed with a filling bore connected to said liquid storage chamber, and means for tight-sealed closing said filling bore according to claim 1, said filling device comprising means for filling said container with liquid through said filling bore.

13. The device as defined in claim 12, further including a filling tube tight-sealed attachable to said filling bore.

14. The device as defined in claim 13, said piston having a back pressure safety means which is mechanically released by said filling tube during a filling process.

15. The device as defined in claim 13, further including means for venting said liquid storage chamber via said filling tube before the filling process.

16. The device as defined in claim 15, including means for inserting said closing means into said filling bore after the completion of the filling process under maintenance of a sealed connection between said filling tube and said filling bore and under displacement of the liquid contained in said container.

17. The device as defined in claim 16, wherein an inner diameter of said filling tube is smaller that an outer diameter of said closing means, at least said filling tube and said closing means being formed of elastic material with spring-restoring properties.

* * * * *